United States Patent [19]

Franzl

[11] 4,100,628

[45] Jul. 18, 1978

[54] ADJUSTABLE SAFETY SEATING DEVICE FOR BATHTUBS

[76] Inventor: Gertrude K. Franzl, 105-25 65th Ave., Forest Hills, N.Y. 11375

[21] Appl. No.: 659,378

[22] Filed: Feb. 19, 1976

[51] Int. Cl.[2] ..... A47K 3/12

[52] U.S. Cl. ..... 4/185 S

[58] Field of Search ..... 4/185 R, 185 S, 185 B, 4/185 AB, 134, 164; 248/188.5; D23/71; D6/86

[56] References Cited

U.S. PATENT DOCUMENTS

| | | | |
|---|---|---|---|
| 913,310 | 2/1909 | Schreibner | 4/185 S |
| 1,002,701 | 9/1911 | Kasztriner | 4/185 S |
| 1,641,514 | 9/1927 | Wiebmer | 4/185 S |
| 1,824,396 | 9/1931 | Erhard et al. | 4/185 S |
| 2,671,908 | 3/1954 | Tronic | 4/185 S |
| 3,022,518 | 2/1962 | Hayden | 4/185 S |
| 3,103,384 | 10/1963 | Zivi | 4/185 R X |
| 3,196,465 | 7/1965 | Montgomery | 4/185 S |
| 3,584,320 | 6/1971 | Locke | 4/185 S |

*Primary Examiner*—Richard E. Aegerter
*Assistant Examiner*—Stuart S. Levy
*Attorney, Agent, or Firm*—John J. Posta, Jr.

[57] ABSTRACT

The improved device is adapted to safely support a person, such as an invalid, in a bathtub and permit such person to wash in privacy without aid. It includes an adjustable support frame, preferably open, which can be adapted to snugly fit into the cavity of a bathtub, and a seat which is adjustable vertically and supported in the frame by adjustable interconnection between a depending seat post and an anchor post secured in the frame.

A safety belt and/or guard rail may be provided to secure the bather in position on the seat. An extension of the seat top which is partly supported by the seat top and partly supported by a pair of collapsible legs is present in one embodiment of the improved device in order to safely support a portion of the torso of a paralyzed or otherwise enfeebled bather. A detachable ladder and detachable bath accessory rack may also be provided.

Preferably the top and extension are porous, and are covered, as is the frame, with a protective resilient layer of rubber or the like. The device offers great convenience, safety and practicality for the care of invalids. It is foldable, compact and easy to use, store and transport.

12 Claims, 4 Drawing Figures

ADJUSTABLE SAFETY SEATING DEVICE FOR BATHTUBS

BACKGOUND OF THE INVENTION

1. Field of the Invention

The present invention generally relates to seats and more particularly to safety seating devices adapted for use in bathtubs.

2. Prior Art

The usual types of built-in bathtub seats are provided at one end of the tubs, usually the rear ends, are quite slippery when wet and cannot be used safely by hospital patients, invalids and the like. It is well recognized that for the physical and emotional well-being of a patient or invalid, he or she should be provided the means with which to bathe in private comfortably and safely. Accordingly, various efforts have been made in the past to design portable bathtub seats effective for such purposes.

However, such seats have largely been unstable and of limited utility and safety, or have been massive, expensive, hard to install and use and, again, of limited utility. Accordingly, there is a need for a simple, inexpensive, safe bathtub seat device capable of being easily adjusted in heighth, width, length and in other features so as to easily fit bathtubs of various sizes and yet safely and sturdily support the bather, even those bathers who are partially paralyzed or otherwise enfeebled.

SUMMARY OF THE INVENTION

The present improved safety bathtub seating device satisfies the foregoing needs. It is substantially as set forth in the Abstract above. Thus, it is inexpensively, yet sturdily and durably constructed of a frame and an adjustable seat. The frame has a curved bottom to fit that of the inside of a bathtub and the frame is adjustable at least in width so as to snugly fit in the bathtub. It may also be adjustable vertically.

It includes an anchor post through which a seat post and thus the seat itself is releasably anchored at any desired heighth in the tub. A safety belt and/or guard rail increase the safety factor.

The seat top preferably is covered with perforated non-slip resilient material and may be designed for easy and rapid attachment thereto of a torso-supporting extension for paralytics, etc.

Detachable components such as a ladder and a bath accessory rack may also be provided. The device, with or without accessories is compact and easily portable. Further features are set forth in the following detailed description and accompanying drawings.

DRAWINGS

Figure 3:
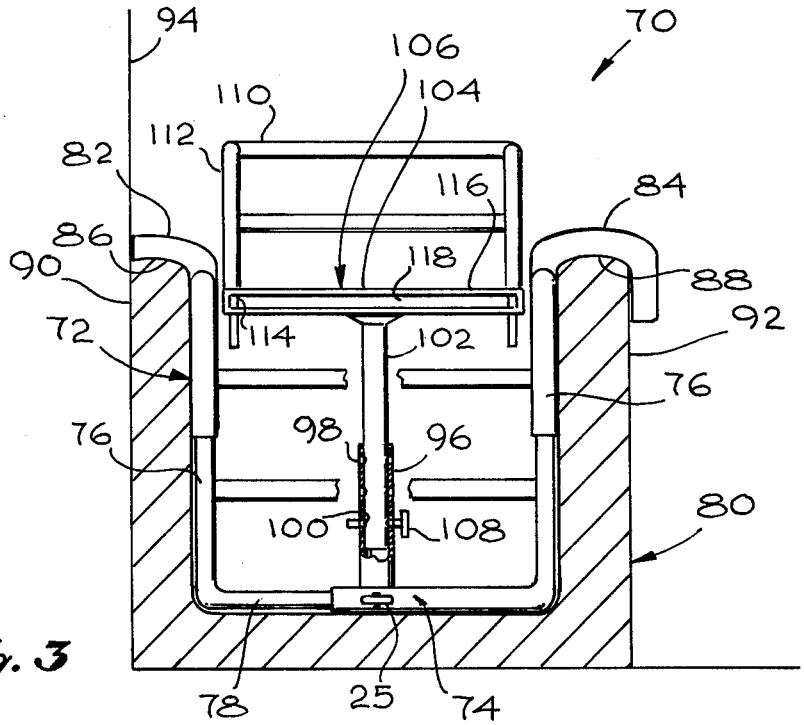
Figure 4:
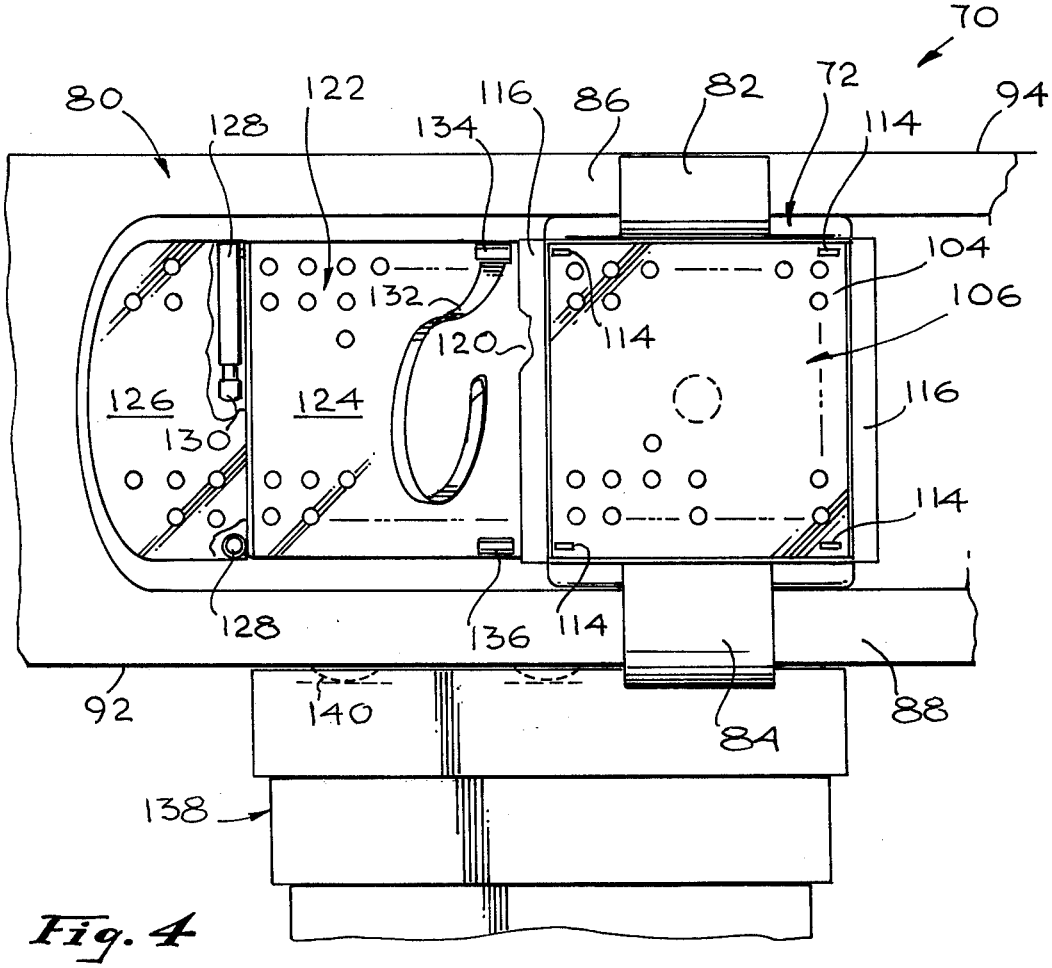

FIG. 3 is a schematic cross section showing a second preferred embodiment of the improved safety seating device of the present invention in place in a bathtub, portions of the device being broken away to illustrate certain internal features; and FIG. 4 is a schematic top plan view of the device of FIG. 3, together with a torso-supporting extension thereof, with safety belt and with a detachable ladder in place, but with the guard rail thereof removed.

DETAILED DESCRIPTION

Figure 1:
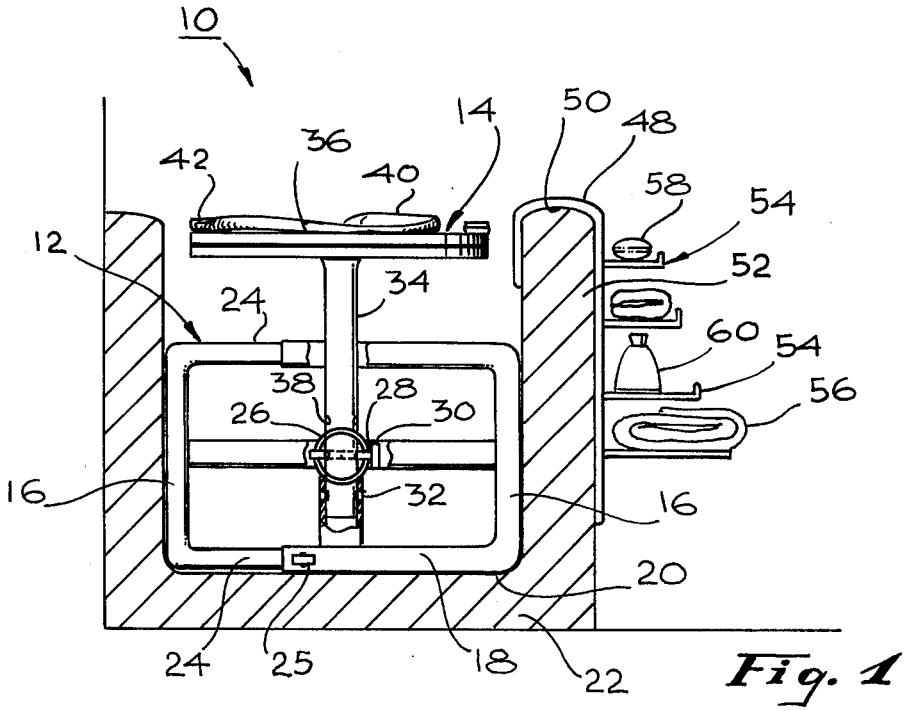
FIG. 1 is a schematic cross-section showing a first preferred embodiment of the improved safety seating device of the present invention in place in a bathtub, portions of the device being broken away to illustrate certain internal features.
Figure 2:
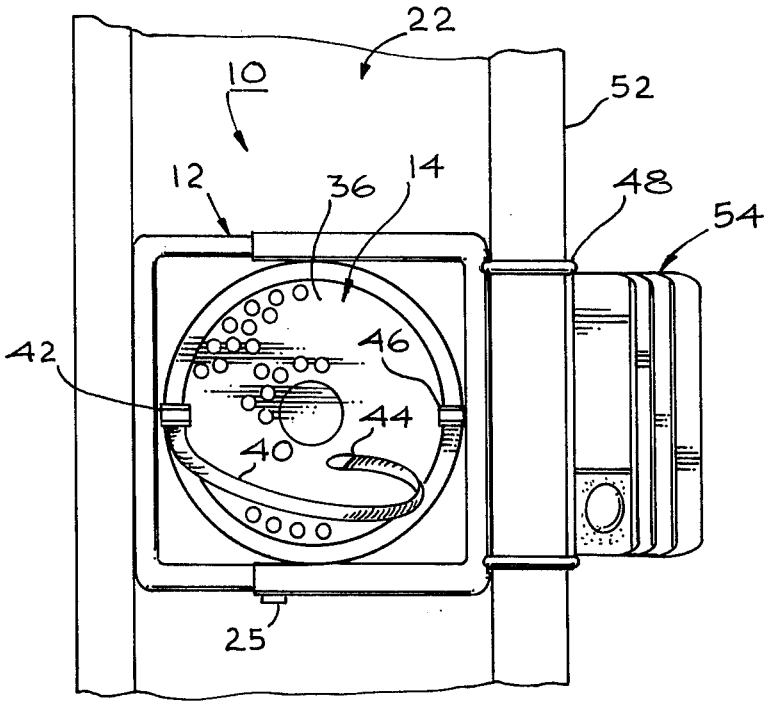
FIG. 2 is a schematic top plan view of the device of FIG. 1.

FIGS. 1 and 2

A first preferred embodiment of the invention is schematically shown in detail in FIGS. 1 and 2. Thus, an improved safety bathtub seating device 10 is shown which comprises a support frame 12 and a seat 14. Frame 12 includes a pluraltiy of interconnected frame members 16 contoured so that the base 18 of frame 12 has the same contour as the base 20 of the inside of bathtub 22 in which device 10 is shown disposed. This assures that frame 12 will not rock in tub 22.

Further assurance of stability of frame 12 is afforded because frame 12 can be adjusted in width. Thus, certain horizontal frame members 24 can, as shown in FIG. 1, telescope within one another. This permits frame 12 to be adjusted to snugly fill the width of tub 22 and be properly braced therein.

A relatively light frictional engagement between telescoping members 24 can be designed into the device to assure their retention in a preselected position. Alternately, a pressure screw key 25 can be provided to lock members 24 in place. Thus, frame 12 is rigid, solid and adjustable, yet can be made light in weight and easily portable.

Frame 12 also includes a horizontal anchor post 26 having a plurality of small spaced apertures 28 therein adapted to receive anchoring means in the form of a releasable locking pin or expansion bolt 30 or the like.

Post 26 also includes a pair of large aligned vertical apertures 32 therein through which a vertical central post 34 depending from the underside of a horizontal seat top 36 passes. Post 34 has a plurality of spaced apertures 38 therein alignable with apertures 28 so as to receive pin 30 and releasably anchor post 34 to post 26 and thus fix seat 14 at any desired height above frame 12, as shown in FIG. 1.

Seat top 36 is shown in FIG. 2 as round in outline, and it is perforated to permit water to run therethrough. Preferably, it and frame 12 are coated with a layer, for example, of 1 inch to 2 inches thickness of resilient non-skid synthetic or natural rubber, plastic, or the like, the rubber of top 36 being perforated.

Device 10 may also include a safety belt 40 secured at one end to an anchor ring 42 secured to top 36, the opposite end 44 of belt 40 being adapted to pass through a releasable lock 46 installed on top 36 opposite ring 42. Belt 40 is used to strap a bather in place when the bather is seated on seat top 36, so as to prevent an injury by having the bather fall off top 36.

Device 10 also includes a detachable accessory rack 48 which releasably hooks over the upper edge 50 of the free-standing side 52 of tub 22 and contains a plurality of vertically spaced horizontal shelves 54 which may hold toiletry and bath items such as towels 56, soap 58, lotion bottle 60, etc.

When device 10 is to be used, frame 12 is inserted in tub 22 and members 24 are slid apart to cause frame 12 to snugly fill the width of tub 22 with frame base 18 firmly resting on tub base 20. If locking key 25 is employed, it is then screwed in to lock members 24 in place.

Seat 14 is then pinned at the correct height in frame via posts 26 and 34 and pin 30, after which the bather can easily sit on top 36, secure herself or himself in place with belt 40 in lock 46 and bathe in privacy, comfort and safety unattended.

Wash water will drain through top 36 and open frame 12 and down the tub drain (not shown). Device 10, once installed, can be left in place between baths or can be just as easily removed and stored.

Device 10 can be fabricated inexpensively of steel, aluminum, reinforced plastic or the like and can be covered with the waterproof resilient non-scratching material as previously described. It is easy to use, effective and durable.

FIGS. 3 and 4

A second preferred embodiment of the device of the present invention is set forth schematically in FIGS. 3 and 4. Thus an improved safety seating device 70 is shown which includes a frame 72 similar to frame 12 and having a curved base 74, spaced telescoping vertical members 76 and a plurality of spaced telescoping horizontal members 78, the latter permitting adjustment of the width of frame 70 to fill bathtub 80, as shown in FIG. 3. Members 76 include curved upper extremities 82 and 84 which are contoured to overlie and rest on the upper edges 86 and 88 of sides 90 and 92 of tub 80. Extremity 82 is shorter than extremity 84 because side 90, which adjoins room wall 94, is thinner than free-standing side 92. Extremities 82 and 84 result in additional rigidity and support for frame 72 as installed in tub 80.

If desired, extremities 82 and 84 can be made from a flexible metal or other material to allow deformation of same to readily conform to different sized bathtubs. Frame 70 is installed by telescoping members 76 and 78 so that the width of tub 80 is filled and frame 72 rests on the bottom of tub 80 while extremities 82 and 84 rest on edges 86 and 88.

Frame 72 also includes a hollow vertical anchor post 96 secured therein and having a plurality of pairs of vertically spaced apertures 98 extending therethrough. Apertures 98 are adapted to match spaced apertures 100 in a vertical center post 102 depending from the underside of horizontal seat top 104 of seat 106, post 102 is slideably received in post 96 and releasably pinned thereto via a pin 108 extending through a pair of apertures 98 in post 96 and an aligned aperture 100 in post 102.

With such an arrangement, after frame 70 is in place, the height of top 104 in tub 80 is adjusted via apertures 98 and 100 and pin 108, whereupon device 70 is ready for use.

It will be noted that top 104 is about square and perforated and includes a guard railing 110, depending legs 112 of which are releasably frictionally engaged in slots 114 which extend vertically through top 106 at the four corners thereof. Thus, guard railing 110 can be raised (FIG. 3), lowered or removed (FIG. 4) as desired.

Frame 72 and seat 106 can be constructed of materials similar to those of frame 12 and seat 14, and can be covered with a similar scratch-resistant resilient material.

Top 104 also includes a pair of hinged flaps 116, each flap 116 having an internal cavity or aperture 118 adapted to releasably receive the end 120 of a torso-supporting extension 122, as shown in FIG. 4, so that the generally flat upper surface of extension 122 can be made substantially continuous with the upper surface of top 104.

Extension 122 is perforated and can be made of materials similar to those of seat 14, including an outer resilient covering. Extension 122 is used to support a portion of the torso of a bather and is particularly useful when a partially paralyzed bather is to be bathed in tub 80.

Extension 122 includes a main section 124 generally similar in size and shape to top 104 but adapted to have end 120 thereof fit into aperture 118 to help support section 124. Extension 122 may also include a curved end section 126 hinged to section 124 and adapted to follow the curved contour of one end of tub 80.

Section 126 includes a spaced pair of hinged foldable and telescopable legs 128 adapted to support extension 122 in tub 80 at the desired height, i.e., on a level with top 104. In FIG. 4, one leg 128 is shown folded and the other unfolded and in the deployed supporting position, with the foot 130 thereof resting on the bottom of tub 80.

It will be noted that extension 122 also includes a safety belt 132, secured by a ring 134 to one side of section 124 and releasably lockable in lock 136 on the opposite side of section 124.

A detachable ladder or step 138 may be releasably secured to the exterior side 92 of tub 80, as by spaced suction cups 140 or the like, to facilitate mounting by the bather to top 104 and extension 122.

If desired, a second extension identical to extension 122 can be provided at the opposite end of seat 106 to support the legs of a bather, and would be attached to seat 106 via openings 118 in the opposite flap 116. The other features and method of use of this second extension would coincide with the features and method of use of extension 122.

Accordingly, device 70 with or without extension 122 is highly useful for invalids, the hospitalized and others. Device 70 with extension 122 in place is particularly useful for those who are partly paralyzed or otherwise enfeebled and incapacitated and need to be supported in a safe reclining position well above the bottom of tub 80 for ease of washing, etc. They can easily be washed and safely removed.

Such an arrangement demands absolute support rigidity and safety. These are afforded by the present novel device.

Device 70, as well as device 10, can easily be removed from tub 80, stored and transported, as in a suitable case or the like. Further features are as set forth in the foregoing description.

Various modifications, changes, alterations and additions can be made in the device of the present invention and in its components. All such modifications, changes, alterations and additions as are within the scope of the appended claims form part of the present invention.

What is claimed is:

1. An improved adjustable safety seating device for bathtubs, said device comprising, in combination:

a. a support frame including:

1. a plurality of interconnected, tubular, longitudinally-extending frame members, said frame members including a plurality of substantially parallel and horizontally extending telescoping members supported by and conforming to the contour of the base portion of a bathtub, said frame members further including a plurality of substantially parallel and vertically extending members lying adjacent to and conforming to the contour of the inner sides of said bathtub, and 2. frame adjustment means to enable adjustment of the frame members to bathtubs having variable inside dimensions, and 3. a seat anchoring means including an anchor post and seat positioning means enabling vertical adjustment of a seat member with respect to said anchor post, and b. a seat including:

1. a generally horizontal, porous, body-supporting top, and 2. a generally vertical center post depending from said top and connected to said anchor post through said seat positioning means.

2. The improved seating device of claim 1 wherein said frame includes at the upper extremities thereof outwardly curved support arms adapted to overlie the upper ends of the sides of a bathtub.

3. The improved seating device of claim 2 wherein said device includes a detachable rack adapted to receive bath accessories.

4. The improved seating device of claim 1 wherein said top includes safety means comprising at least one of an adjustable safety belt and a guard rail and wherein said top and frame are covered with a protective layer of resilient material, the material of said top being porous.

5. The improved seating device of claim 1 wherein said anchor post is disposed generally horizontally in said frame and wherein said two posts include a plurality of aligned apertures through which removable pin means are disposed.

6. The improved seating device of claim 1 wherein said anchor post is disposed generally vertically in said frame, and wherein said center post is slideably received in said anchor post and releasably secured thereto by removable pins means extending through aligned apertures in said posts.

7. The improved seating device of claim 1 wherein said device includes an extension comprising a generally flat perforated torso-supporting section releasably connected to one end of said top to provide a substantially continuous surface therewith and a curved end section foldably connected thereto and adapted to fit the curvature at the end of a bathtub, said extension including a pair of foldable extensible legs adapted to support said sections at the level of said top.

8. The improved seating device of claim 7 wherein said top includes an aperture adapted to receive a portion of said torso-supporting section to support the same and form said substantially continuous surface therewith.

9. The improved seating device of claim 8 wherein a pair of said apertures are disposed in a pair of foldable flaps disposed on opposite ends of said top, whereby said extension can be secured at either of said opposite ends of said top.

10. The improved seating device of claim 9 whereby an extension can be secured to each side of said top simultaneously.

11. The improved seating device of claim 7 wherein at least one of said top and said extension includes safety means including at least one of an adjustable belt and a guard rail.

12. The improved seating device of claim 7 wherein said top device includes a detachable ladder.

* * * * *